US011814754B2

(12) United States Patent
Klinzing et al.

(10) Patent No.: US 11,814,754 B2
(45) Date of Patent: Nov. 14, 2023

(54) MACHINES SYSTEMS AND METHODS FOR MAKING RANDOM FIBER WEBS

(71) Applicant: 3M INNOVATIVE PROPERTIES COMPANY, St. Paul, MN (US)

(72) Inventors: William P. Klinzing, West Lakeland, MN (US); Warren D. Eaton, St. Paul, MN (US); Jon A. Lindberg, Prairie du Chien, WI (US); David C. Raithel, Hudson, WI (US); Kyle J. Baumgartner, Strawberry Point, IA (US); James C. Breister, Oakdale, MN (US); Joseph A. Dunbar, Woodbury, MN (US); James P. Endle, New Richmond, WI (US); Blake R. Griffith, Oakdale, MN (US); Sylvain M. Lalonde, Ontario (CA); Cristobal Martin Bernia, Madrid (ES); Jesse R. Seifert, New Richmond, WI (US); Joshua D. Tibbits, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 17/250,595

(22) PCT Filed: Aug. 8, 2019

(86) PCT No.: PCT/US2019/045604
§ 371 (c)(1),
(2) Date: Feb. 8, 2021

(87) PCT Pub. No.: WO2020/033617
PCT Pub. Date: Feb. 13, 2020

(65) Prior Publication Data
US 2021/0355615 A1 Nov. 18, 2021

Related U.S. Application Data

(60) Provisional application No. 62/717,095, filed on Aug. 10, 2018.

(51) Int. Cl.
*D01G 15/20* (2006.01)
*D01G 15/46* (2006.01)
*D04H 1/732* (2012.01)

(52) U.S. Cl.
CPC ..... *D01G 15/20* (2013.01); *D01G 15/46* (2013.01); *D04H 1/732* (2013.01)

(58) Field of Classification Search
CPC ..... D01G 15/20; D01G 15/46; D01G 15/465; D01G 15/40; D01G 25/00; D04H 1/72; D04H 1/732
(Continued)

(56) References Cited

U.S. PATENT DOCUMENTS 2,890,497 A * 6/1959 Marks ..... D04H 1/72 19/303
3,414,444 A * 12/1968 Bobkowicz ..... D01H 4/28 264/441
(Continued)

FOREIGN PATENT DOCUMENTS

WO WO 1988-05838 8/1988
WO WO 2009-089579 7/2009
WO WO 2020-033616 2/2020

OTHER PUBLICATIONS

International Search Report for PCT International Application No. PCT/US2019/045604, dated Nov. 18, 2019, 5 pages.

*Primary Examiner* — Aiying Zhao
(74) *Attorney, Agent, or Firm* — Katherine M. Scholz

(57) ABSTRACT

Methods and systems of forming a random fiber web using pneumatic fiber feeding system are disclosed. The method
(Continued)

can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; communicating an air supply to entrain the plurality of fibers with the air supply after the doffing; and collecting the plurality of fibers from the air supply to form the random fiber web.

12 Claims, 11 Drawing Sheets

(58) Field of Classification Search
USPC ..... 19/105, 106 R, 109, 296
See application file for complete search history.

(56) References Cited

U.S. PATENT DOCUMENTS 3,748,693 A 7/1973 Jesperson
3,768,119 A * 10/1973 Wood ..... D04H 1/72 19/306
3,768,120 A * 10/1973 Miller ..... D04H 1/72 19/306
3,918,126 A 11/1975 Wood
3,972,092 A * 8/1976 Wood ..... D01G 25/00 425/82.1
4,004,323 A 1/1977 Gotchel
4,064,600 A * 12/1977 Gotchel ..... D04H 1/732 19/306
4,097,965 A * 7/1978 Gotchel ..... D01G 25/00 156/62.4
4,375,447 A 3/1983 Chang
4,375,448 A 3/1983 Appel
4,388,056 A 6/1983 Lee
4,403,374 A 9/1983 Wood
4,514,880 A * 5/1985 Vaughn ..... D04H 1/4242 19/0.35
4,640,810 A 2/1987 Laursen
4,812,283 A * 3/1989 Farley ..... B29C 70/443 264/518
6,939,492 B2 9/2005 Jackson
2004/0134355 A1* 7/2004 Kasmark, Jr. ..... B01D 39/2055 96/154
2007/0056674 A1 3/2007 Sellars
2009/0056091 A1 3/2009 Jezzi

* cited by examiner

MACHINES SYSTEMS AND METHODS FOR MAKING RANDOM FIBER WEBS

CROSS REFERENCE TO RELATED APPLICATIONS

This application is a national stage filing under 35 U.S.C. 371 of PCT/US2019/045604, filed Aug. 8, 2019, which claims the benefit of U.S. Provisional Application No. 62/717,095, filed Aug. 10, 2018, the disclosure of which is incorporated by reference in its/their entirety herein.

BACKGROUND

The present disclosure relates to methods, systems and machines for forming random fiber webs. More particularly, it relates to machines, systems and methods for creating non-woven air-laid webs.

In general, various machines, systems and methods are known for making random fiber webs for random fiber articles that are used for various purposes. Cleaning and abrading apparatuses are partially formed of random fiber webs. Additionally, disposable absorbent products such as mortuary, veterinary and personal care absorbent products such as diapers, feminine pads, adult incontinence products, and training pants often include one or more layers of random fiber web materials, especially liquid absorbent fiber web materials.

SUMMARY

Aspects of the present disclosure are directed toward machines, systems and methods of making non-woven air-laid webs. One known machine 10 for creating a non-woven air-laid web is shown in reference to FIG. 1. Such machine 10 relies on an initial random fiber mat that is fed to a rotating lickerin 12 such as by a feed roll 14. The lickerin 12 is configured to comb individual fibers from the initial random fiber mat (not shown in FIG. 1). The lickerin 12 then doffs the combed fibers therefrom using centrifugal force and the combed fibers enter an air supply AS flowing past the lickerin 12 and a saber roll 16. The doffed fibers are carried entrained in the air supply AS to a condenser 18. The fibers are deposited on the condenser 18 in a random fashion to form the non-woven fiber web (not shown in FIG. 1).

Unfortunately, the above described machine often has a non-uniform deposition of the fibers on the condenser 18. This has led to further costly processing steps to create a more uniform web deposition. For example, with the machine of FIG. 1, portions of the non-woven fiber web such as along the cross-web edge regions thereof may be removed due to the non-uniform deposition of the fibers on the condenser 18.

The present inventors have recognized machines which modify the machine of FIG. 1 to provide for a more uniform deposition of the fibers on the condenser. Such machines reduce processing costs and can reduce the need for further post deposition steps. One realization of the present inventors was the machine of FIG. 1 was doffing an undesirable amount of the combed fibers against one or both of a doffer plate 20 and a lower slide plate 22. These fibers were not being entrained in the air supply AS and clumped together rolling down one or both of the doffer plate 20 and the lower slide plate 22 to the condenser 18. This was suspected as one cause of the non-uniform deposition discussed above. In response, the present inventors propose various solutions, machines and the like, including those with the doffer plate and/or the lower slide plate being removed or having a modified geometry with respect to the machine of FIG. 1.

The present inventors have also realized other components and machine embodiments that allow for an improved more uniform deposition of the fibers on the condenser. These components variously include the addition of a seal having a reverse orientation relative to a direction of rotation of the condenser, one or more ports in a housing of the machine that allow for viewing of the doffing of the fibers and/or lay-up of the fibers on the condenser, addition of a nose bar and/or nose bar extension that changes the doffing point of the fibers into the air stream, the addition of various air venting passages in the housing, a doffer plate and/or the lower slide plate configured to facilitate venting and/or air intake into and/or out of the air supply to name but a few. Further components and machines embodiments are disclosed herein and discussed with reference to the FIGURES.

In one embodiment a method of forming a random fiber web using pneumatic fiber feeding system is disclosed. The method can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; communicating an air supply to entrain the plurality of fibers with the air supply after the doffing; and collecting the plurality of fibers from the air supply to form the random fiber web.

In another embodiment, a pneumatic fiber feeding system for forming a random fiber web. The system can optionally comprise: a feeder; a lickerin configured to remove a plurality of fibers from a fibrous mat delivered to adjacent the lickerin by the feeder and configured to doff the plurality of fibers from the lickerin; a channel communicating an air supply to a space adjacent the lickerin, the space including a doffing location where the doff of the plurality of fibers from the lickerin occurs; and a collector positioned to capture the plurality of fibers once doffed into the air supply, the plurality of fibers forming the random fiber web on the collector.

In another embodiment, a pneumatic fiber feeding system for forming a random fiber web. The system can optionally comprise: a plurality of moveable apparatuses including a lickerin and a feeder, the lickerin configured to remove a plurality of fibers from a fibrous mat delivered to adjacent the lickerin by the feeder, wherein the lickerin is configured to doff the plurality of fibers from the lickerin; a channel communicating an air supply to a space adjacent the lickerin, the space including a doffing location where the doff of the plurality of fibers from the lickerin occurs; a collector positioned to capture the plurality of fibers once doffed into the main air supply, the plurality of fibers forming the random fiber web on the collector; and at least one of: a drum, one or more passages that communicate with the channel downstream of the doffing location, and a restriction in the channel downstream of the doffing location and prior to the collector.

DETAILED DESCRIPTION

Figure 1:
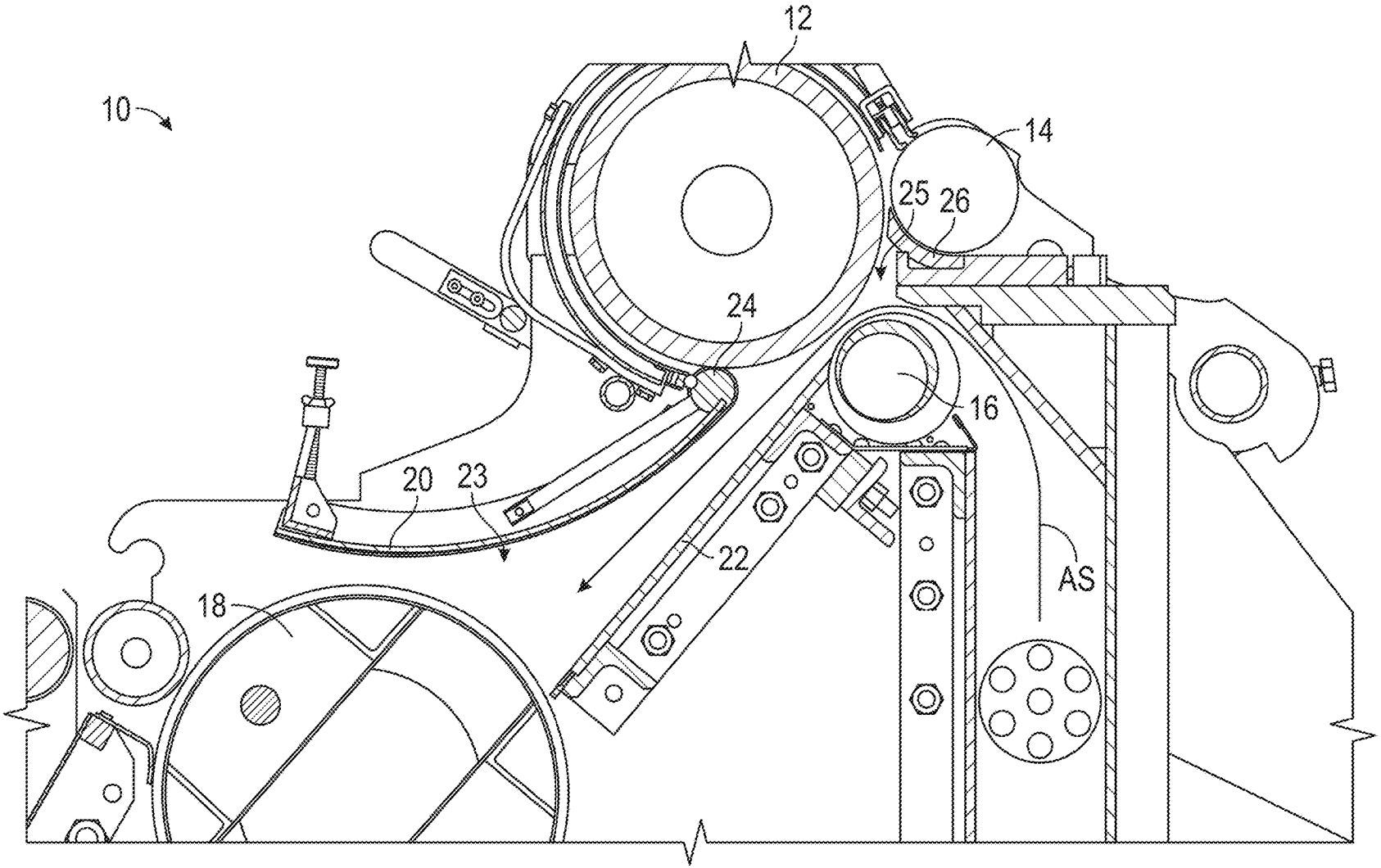
FIG. 1 (Prior Art)
FIG. 1 is a schematic cross-section of a portion of a machine for forming a random fiber web as is known in the prior art.

Aspects of the present disclosure relate to machines, systems and methods for manufacturing random fiber webs. As a point of reference, FIG. 1 illustrates portions of the known machine 10 for forming a random fiber web and has been previously discussed in reference to the summary above. In such machine 10, the webs are suitable for producing non-woven fabrics by known chemical or mechanical bonding treatments. For example, dry formed structures may be chemically bonded by known means such as the application of adhesives by spray or by saturation, also bonding may be accomplished by the use of fibers, which can have a low melting point and form a bond to non-adhesive fibers by heat and pressure. Mechanical bonding may be carried out by needling, stitch bonding, print bonding or the like. The quality of any non-woven fabric produced by these finishing methods depends upon the quality and uniformity of the web structure which is to be treated or finished.

Still referring to FIG. 1, the processes described herein can be run at high volume. For example, with the machine 10 doffed fibers can be projected at an initial velocity of up to 5,000 feet per minute by the lickerin 12, which can rotate at the same velocity. Velocities of up to 20,000 feet per minute are not uncommon for the lickerin 12. Doffed fibers can entrain with the air supply AS passing adjacent the lickerin 12. The air supply AS, with the doffed fibers entrained therein, passes from adjacent the lickerin 12 into a chamber 23 that is partially defined by the doffer plate 20 and the lower slide plate 22. These two plates typically have an angle of less than 15° initially. However, the doffer plate 20 and the lower slide plate 22 are angled relative to one another such that the chamber 23 increases in its cross-section from adjacent the lickerin to adjacent the condenser 18. The air supply AS can be controlled so that the doffed fibers are projected into air supply AS with an average velocity of the air flow in the air supply AS being between 0.5 and 1.5 times the initial fiber velocity. The doffed fibers are preferably projected onto the condenser 18 at a rate of between 3 and 30 pounds per hour per inch of machine width or air flow width, although the machine 10 can be suitable for slower and higher rates of operation. Large volumes of air are typically used as the air supply AS to convey the doffed fibers to the condenser 18. Operating with 20 to 30 times weight of air to weight of fiber processed per unit of time, at standard conditions of density and temperature (0.075 lbs. per cu. ft. at 70° F. and 29.92" Hg) is typical.

It is desired that the air supply AS have uniform velocity, low turbulence, with a stable air stream, free from vorticities, in the direction of movement of the lickerin 12. Unfortunately, such is not always the case with machine 10. It was previously thought with the design of the channel/chamber that convey the air supply AS should be shaped to create a venturi 25 in the region adjacent the lickerin 12 where the fibers are doffed upstream of the chamber 23. Furthermore, a boundary layer which is formed around the surface of the lickerin 12 can be interrupted by the use of a doffing bar 24, which is situated adjacent the chamber 23 at a point of maximum shear just below the lickerin 12 at the start of the chamber 23 (sometimes called the expansion chamber). The doffing bar 24 is configured to provide a controlled low level of turbulence in the air supply AS through which the doffed fibers pass.

A nose bar 26 can be utilized and positioned at a small distance from the surface of the lickerin 12 to provide a narrow passage where the fibers are carried on hooks, projections or pieces of the wire covering or a cylinder surface of the lickerin 12 to a point of projection (called a doffing point or doffing location) into the venturi 25 and the air supply AS. The saber roll 16 can be positioned adjacent the nose bar 26 and the lickerin 12 and can be positioned in and adjacent the air supply AS. The saber roll 16 can be journaled for eccentric movement in the side housings of the machine 10. The saber roll 16 spreads the flow of the air supply AS and aids in doffing the fibers from the lickerin 12. The eccentric mounting of the saber roll 16 allows of varying the space between the lickerin 12 and the saber roll 16 so as to restrict the air supply AS to the doffing location.

As discussed above, the present inventors have recognized components which modify the machine 10 of FIG. 1 to provide for a more uniform deposition of the fibers on the condenser. More particularly, the present inventors recognized with the machine 10 of FIG. 1, the doffing location and doffing trajectory is undesirable, and typically leads to a non-uniform deposition of the fibers on the condenser 18 due to at least some of the fibers being doffed toward and contacting the doffer plate 20 and/or the lower slide plate 22 and becoming jumbled and entangled together. Furthermore, the present inventors recognized the machine 10 of FIG. 1 is susceptible to turbulent airflow, air flow surges and/or vortices due to factors including a fully enclosed expansion chamber and fully enclosed other portions of a channel that communicates the air supply AS within the machine 10. The use of the venturi 25 at and just after the doffing location was also determined by the present inventors to be unnecessary in all embodiments. The present inventors also recognize modifications to the expansion chamber geometry, and indeed, in some cases elimination or modification of the doffer plate 20 and/or the lower slide plate 22 can be desirable.

Figure 2:
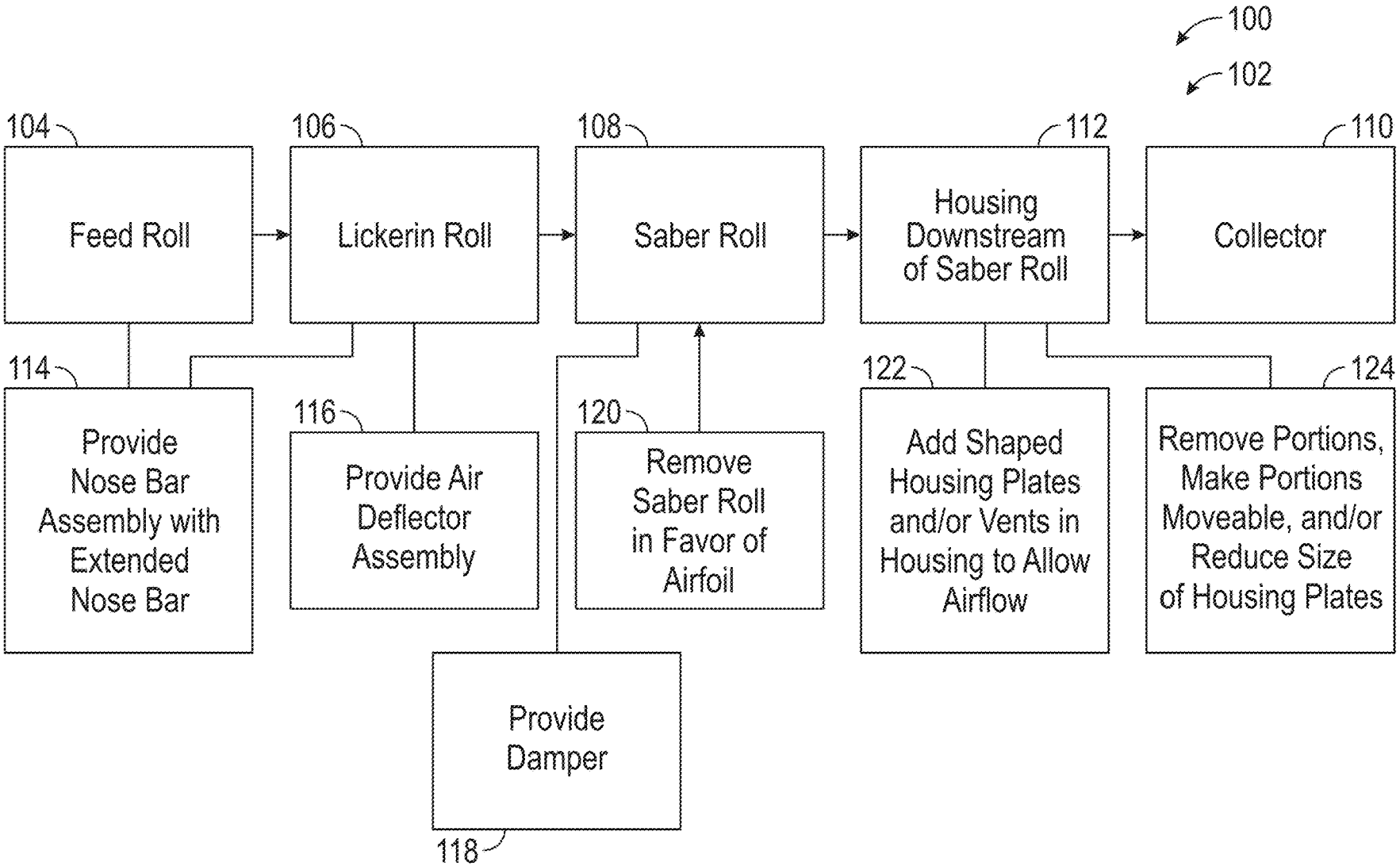
FIG. 2 is a high level schematic diagram tracking some modifications and/or additional components to a system for forming a random fiber web according to an embodiment of the present disclosure.

FIG. 2 shows a highly schematic method 100 of forming a random fiber web using a pneumatic fiber feeding system 102. The method can include providing a plurality of rotatable rolls. These rotatable rolls can include a feed roll 104, a lickerin roll 106, and a saber roll 108. The term "roll" as used herein is broadly defined to mean any of a moveable, driven or feed type apparatus such as a belt, and is therefore not limited only to rotatable apparatuses such as a roll. The lickerin roll 106 can be configured with hooks, projections and/or other features to remove a plurality of fibers from a fibrous mat delivered to adjacent the lickerin roll by the feed roll 104. The saber roll 108 can be moveably positioned adjacent (within less than an inch to a few inches of) the lickerin roll 106.

The method 100 can include doffing the plurality of fibers from the lickerin roll at a doffing location within the system 102. The method 100 can further include communicating an air supply to entrain the plurality of fibers with the air supply after the doffing. Additionally, the method 100 can include collecting the plurality of fibers from the air supply to form the random fiber web. Such collection of the fibers can occur at a collector 110 (also call a condenser). The collector can comprise a moveable apparatus such as a roll or belt that can move to gather the laid-up fibers to form the new random fiber web as they fall to the collector 110.

The air supply AS with the plurality of fibers entrained therein can pass through a channel (also called a chamber, space or volume herein) that is downstream (in terms of a direction of flow of the air supply AS) from adjacent the lickerin roll 106 and the saber roll 108. This channel can extend from adjacent the lickerin roll 106 and the saber roll 108 to adjacent the collector 110. The channel can be at least partially defined by a housing 112 (this housing 112 can include the doffer plate, the lower slide plate, and/or the side housings as previously described herein).

As has been previously discussed and will be further discussed herein subsequently, the present inventors have modified the method 100 and the system 102 from the method and machine of FIG. 1. FIG. 2 shows just some system and component modifications that the present inventors contemplate. These modifications and components are further described in reference to FIGS. 3-11. Further components and modifications are discussed in co-pending application No. 62/717,069 entitled "MACHINES SYSTEMS AND METHODS FOR MAKING RANDOM FIBER WEBS" filed on the even day with the present application the entire disclosure of which is incorporated herein in its entirety.

Specifically, FIG. 2 illustrates a number of possible additions to the method 100 and the system 102 that can be utilized. These additions can be utilized together in a single embodiment, alone or in various combinations. Such additions can include providing for a nose bar assembly 114 that can include an extended nose bar between the feed roll 104 and the lickerin roll 106. The method 100 and system 102 can include providing for an air deflector assembly 116 positioned between the lickerin roll 106 and the saber roll 108. The air deflector assembly 116 can be mounted to a housing of the machine adjacent to the feed roll 104 and can extend into the space to adjacent the lickerin roll 106. The method 100 and system 102 can include providing a damper 118 adjacent the saber roll 108 to control air flow around the saber roll 108. The method 100 and system 102 can include providing an airfoil 120 that can be used in lieu of the saber roll 108.

Steps 122 and 124 of the method 100 and/or system 102 can comprise various configurations for the housing 112, which can include, but is not limited to, the doffer plate, the lower slide plate, and/or the side housings as previously described and illustrated and are further described and illustrated herein. The method 100 and system 102 can include providing for one or more of shaped housing plates, a vented housing, and/or vented housing plate(s) at step 122. These modifications can be implemented together, in any combination, individually or in combination with the modifications of step 124 as desired. The method 100 and system 102 can include providing for one or more of truncated housing portions (housings with reduced extent), entire removal of one or more portions of the housing, and/or having one or more portions of the housing be moveable at step 124. These modifications can be implemented together, in any combination, individually or in combination with the modifications of step 122 as desired.

Figure 3:
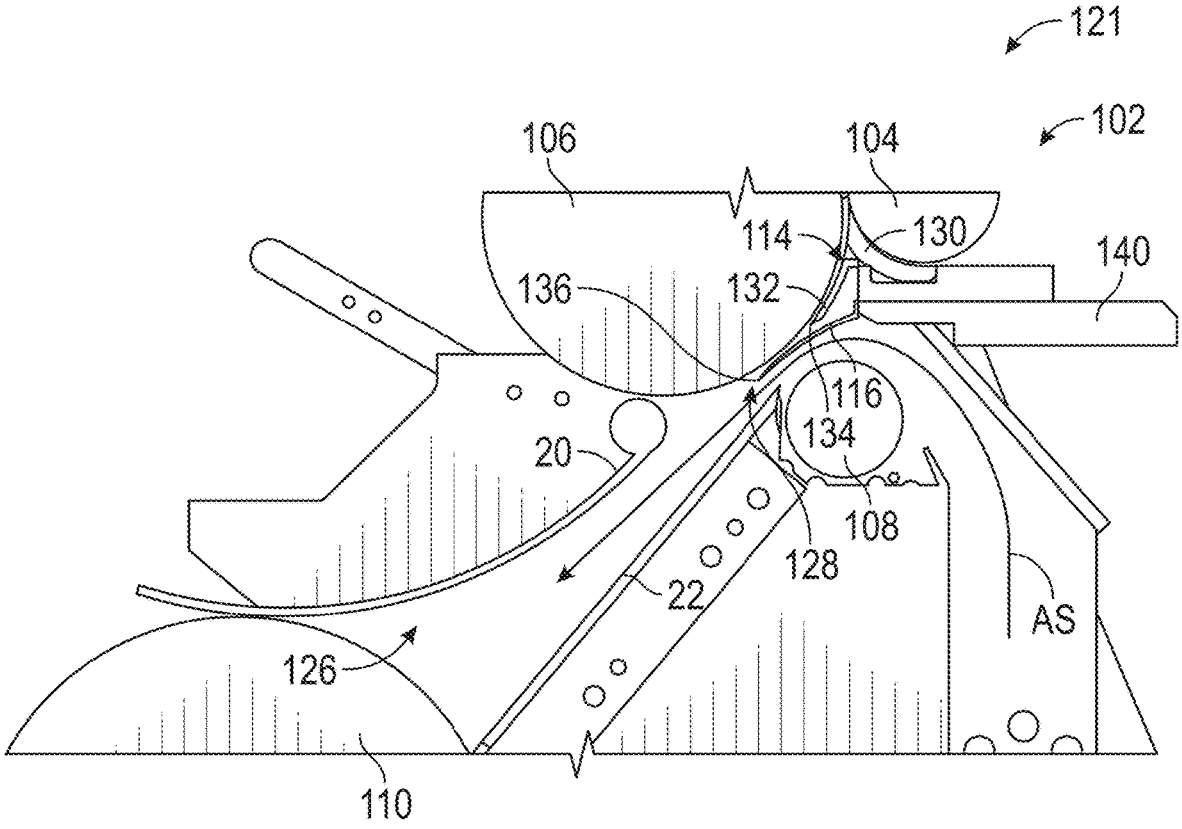
FIG. 3 is a schematic cross-section of a portion of a first machine for forming a random fiber web according to an embodiment of the present disclosure.

FIG. 3 shows two additions discussed in reference to the system 102 and method 100 of FIG. 2 utilized together in a machine 121 having an air supply AS. As was discussed in FIG. 2, in FIG. 3 the machine 121 can include a feed apparatus (e.g., rotatable feed roll 104), a lickerin (e.g., lickerin roll 106) a saber (e.g., the saber roll 108), a channel 126 including a space 128 and the collector 110. The rotatable lickerin roll 106 can be configured to remove a plurality of fibers from a fibrous mat delivered to adjacent the lickerin roll 106 by the feed roll 104. The lickerin roll 106 can be configured to doff the plurality of fibers from the lickerin roll 106. The rotatable saber roll 108 can be positioned adjacent the feed roll 104 and the lickerin roll 106. The channel 126 can communicate the air supply AS to the space 128 defined between the lickerin roll 106 and the saber roll 108. The space 128 can include a doffing location where the doff of the plurality of fibers from the lickerin roll 106 occurs. The rotatable collector 110 can be positioned to capture the plurality of fibers once doffed into the air supply AS. The plurality of fibers, when laid-up, form the random fiber web on the collector 110.

The air deflector assembly 116 can comprise a thin sheet of material that is positioned between the lickerin roll 106 and the saber roll 108. The air deflector assembly 116 can be mounted to a housing portion 140 of the machine 121 adjacent to the feed roll 104 and can extend into the space 128 to adjacent (within less than an inch or less than a few inches) of the lickerin roll 104.

The embodiment of FIG. 3 further shows the nose bar assembly 114 positioned adjacent the lickerin roll 106 and extending along the lickerin roll 106 toward the saber roll 108 for the machine 121. More particularly, the nose bar assembly 114 can include a nose bar 130 and a nose bar extension 132. The nose bar extension 132 and the nose bar 130 can be coupled together. The nose bar extension 132 can extend along the lickerin roll 106 and toward the saber roll 108.

In the embodiment of FIG. 3, the nose bar extension 132 can be separated from the space 128 by the air deflector assembly 116, which is positioned between the nose bar extension 132 (and indeed extends between the lickerin roll 106 and the saber roll 108) and the space 128. In FIG. 3, the air deflector assembly 116 is positioned and configured to deflect the air supply AS away from the nose bar extension 132 and the doffing location (i.e., the location where the plurality of fibers are doffed from the lickerin roll 106). Thus, the doffing location can be located in a second space 134 defined between the lickerin roll 106 and the air deflector assembly 116 adjacent a termination point of the nose bar extension 132. Thus, the doffing location is in the second space 134 and is not directly in the air supply AS in the space 128 due to the presence of the air deflector assembly 116. Put another way, in the embodiment of FIG. 3, the doffing location is not directly positioned in the air supply AS but is separated therefrom by the air deflector assembly 116.

The nose bar assembly 114 can be positioned at least partially between the feed roll 104 and the lickerin roll 106 and can extend into the second space 134. The nose bar assembly 114 can be positioned adjacent to (within less than an inch or less than a few inches) and can extend around a portion of the circumference of the lickerin roll up to 170 degrees. The nose bar assembly 114, and in particular, the nose bar extension 132 can control the doffing location and trajectory. The nose bar extension 132 can be shaped and positioned such that the doffing location and trajectory is shifted so the plurality of fibers clear the air deflector assembly 116, the doffer plate 20 and/or the lower slide plate 22 and are better positioned to entrain in the air supply AS after passing the end 136 of the air deflector assembly 116.

Figure 4:
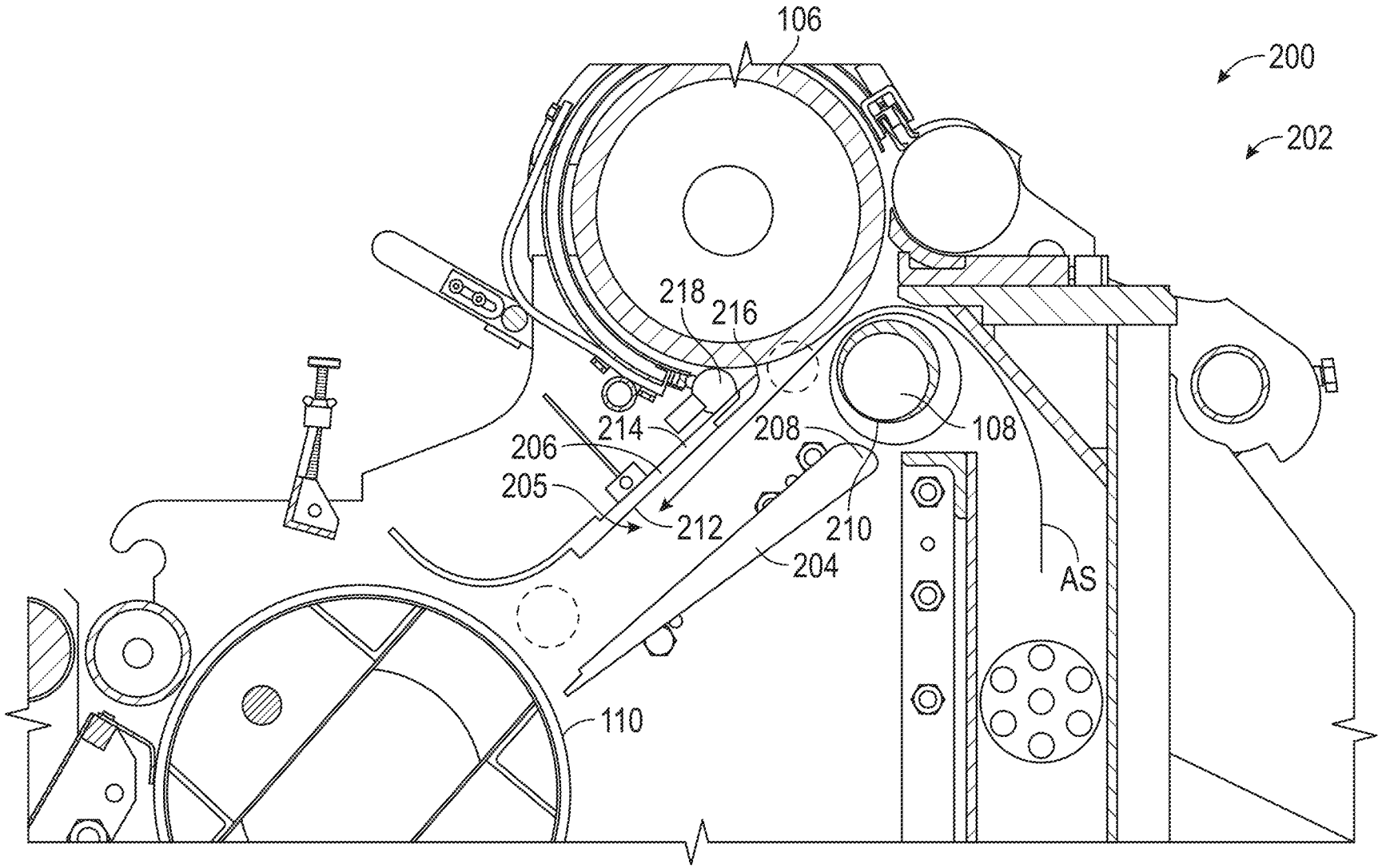
FIG. 4 is a schematic cross-section of a portion of a second machine for forming a random fiber web according to an embodiment of the present disclosure.

FIG. 4 shows a system 200 that is part of a machine 202 that includes a lower slide plate 204 and doffer plate 206 that are modified relative to the doffer plate 20 and the lower slide plate 22 of FIG. 1. Together the lower slide plate 204, the doffer plate 206 and side walls of the machine 202 form a channel 205 that differs geometrically from the chamber 23 of FIG. 1. The lower slide plate 204 and the doffer plate 206 can be used in combination as shown in FIG. 4, or alone in other embodiments. The lower slide plate 204 can have a shifted position relative to that of the lower slide plate 22. In particular, a proximal end portion 208 of the lower slide plate 204 can be positioned relatively further away from the lickerin roll 106 then the lower slide plate 22. Indeed, a majority to all of the lower slide plate 204 at a proximal end portion 208 thereof can be positioned below the saber roll 108 closely adjacent a portion 210 of the saber roll 108 that is spaced further from the lickerin roll 106. In such embodiments, ambient air may flow between the gap between the saber roll 108 and the proximal end portion 208 to interact with the air supply AS. Such ambient air may enter the interior of the machine 202 through one or more passages (not shown in FIG. 4) akin to passage 610 of FIG. 8. It should be understood that the one or more passages need not be positioned in the location shown in the figures, which is merely indicated for schematic purposes.

In the embodiment of FIG. 4, the doffer plate 206 can also have a modified configuration and position relative to the doffer plate 20. In particular, the doffer plate 206 has a substantially planar surface 212 along a portion 214 of channel interfacing extent of the plate 206. This surface 212 can be configured to align with a direction of flow of the air supply AS. As also shown in FIG. 4, a first end portion 216 of the doffer plate 206 extends past at least a majority of a doffer bar 218 and can extend to adjacent (within a few inches of) the lickerin roll 106.

Figure 5:
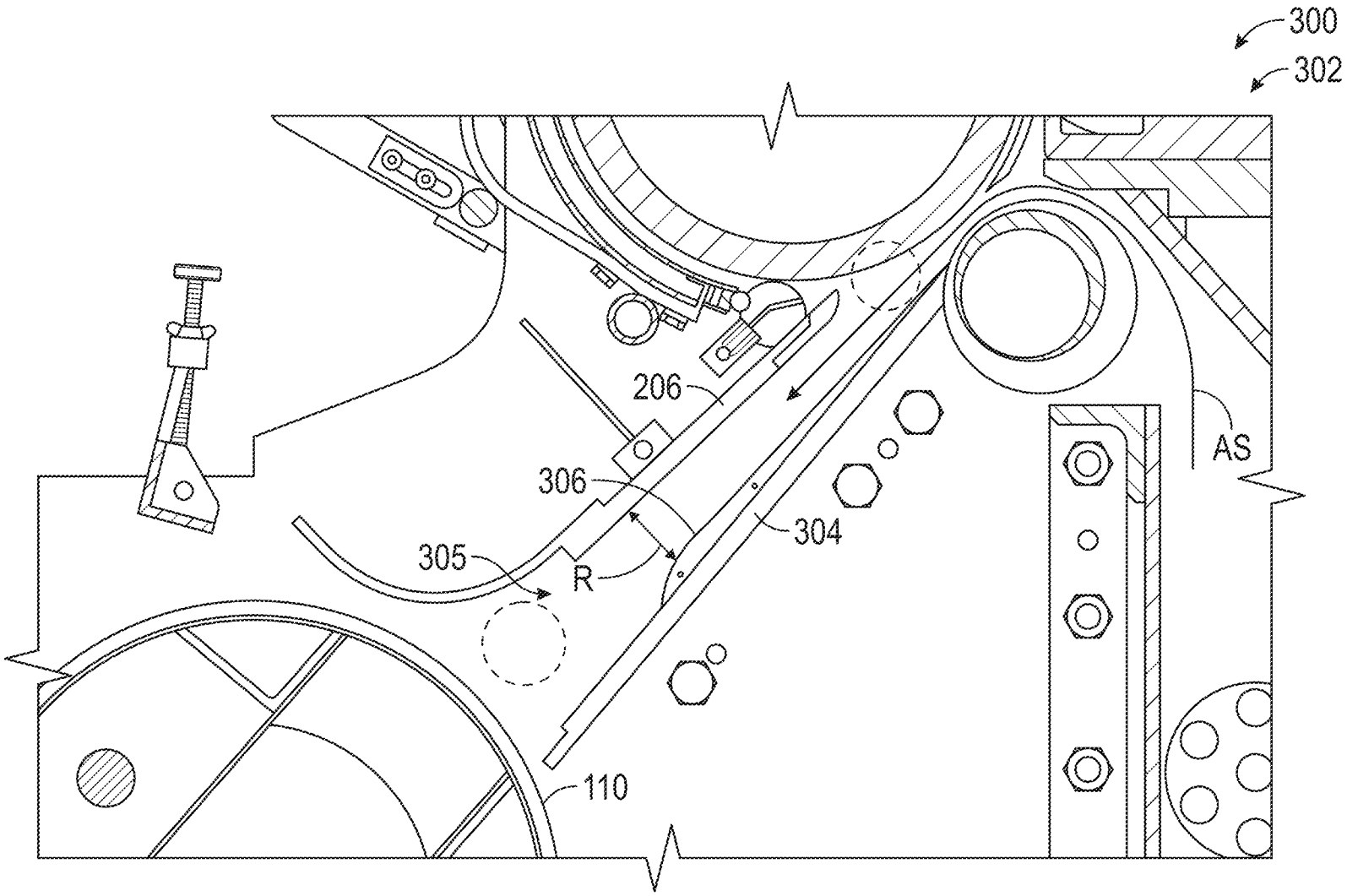
FIG. 5 is a schematic cross-section of a portion of a third machine for forming a random fiber web according to an embodiment of the present disclosure.

FIG. 5 shows another embodiment of a system 300 that is part of a machine 302 that includes a lower slide plate 304. The system 300 and the machine 302 can utilize the doffer plate 206 of FIG. 4. The system 300 can have a channel 305 that differs in geometry relative to the channel 205 of FIG. 4 as a result of the configuration and position of the lower slide plate 304 differing from the lower slide plate 204 of FIG. 4. In particular, the lower slide plate 304 has a projecting surface 306 that forms a portion of the channel 305. Together, this projecting surface 306 in combination with the geometry of the doffer plate 206 as previously discussed are configured to cause a restriction R in the channel 305 prior to the air supply AS with the plurality of fibers entrained therein reaching the collector 110. The result of the configuration of the lower slide plate 304 is to spread the air supply AS with the plurality of fibers entrained therein more evenly across the channel 305 (across referring to a cross-web direction of FIG. 5 into the page) prior to the air supply AS reaching the collector 110. In some embodiments, ambient air may enter the interior of the machine 302 through one or more passages (not shown in FIG. 5) akin to passage 610 of FIG. 8. It should be understood that the one or more passages need not be positioned in the location shown in the figures, which is merely indicated for schematic purposes.

Figure 6:
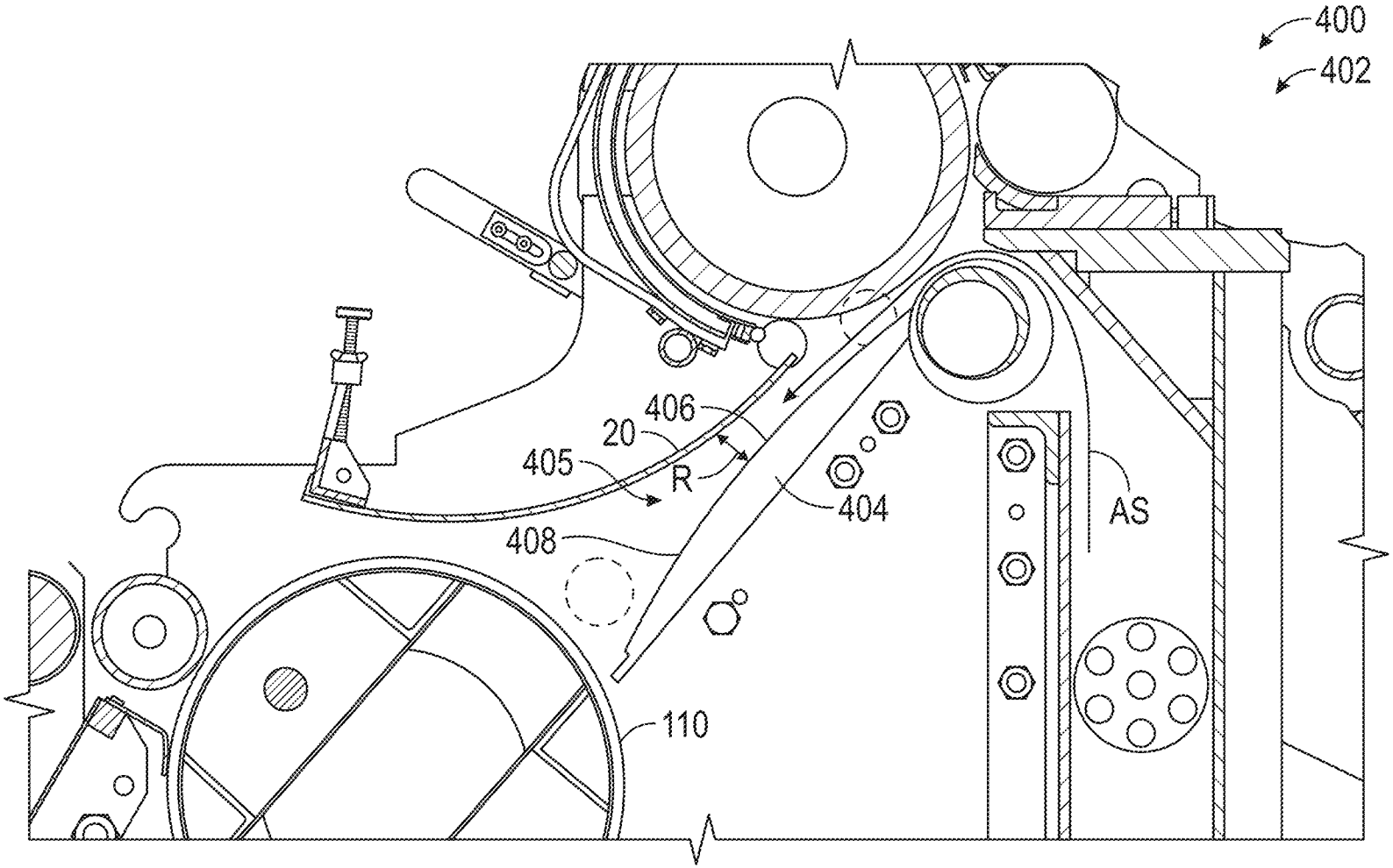
FIG. 6 is a schematic cross-section of a portion of a fourth machine for forming a random fiber web according to an embodiment of the present disclosure.

FIG. 6 shows another embodiment of a system 400 that is part of a machine 402 that includes a lower slide plate 404. The system 400 and the machine 402 can utilize the doffer plate 20 of FIGS. 1 and 3. The system 400 can have a channel 405 that differs in geometry relative to the channels 205 of FIG. 4 and 305 of FIG. 5 as a result of the configuration and position of the lower slide plate 404 differing from the lower slide plate 204 of FIG. 4 and the lower slide plate 304 of FIG. 5. In particular, the lower slide plate 404 has a surface 406 along the channel 405 interfacing extent thereof. The surface 406 has a section 408 that is convex in shape when viewed in cross-section. Similar to the configuration of FIG. 4, the configuration of the lower slide plate 404 in combination with the doffer plate 20 cause a restriction R in the channel 405 prior to the air supply AS with the plurality of fibers entrained therein reaching the collector 110. The result of the configuration of the lower slide plate 404 is to spread the air supply AS with the plurality of fibers entrained therein more evenly across the channel 405 (across referring to a cross-web direction of FIG. 6 into the page) prior to the air supply AS reaching the collector 110. In some embodiments, ambient air may enter the interior of the machine 402 through one or more passages (not shown in FIG. 6) akin to passage 610 of FIG. 8. It should be understood that the one or more passages need not be positioned in the location shown in the figures, which is merely indicated for schematic purposes.

Figure 7:
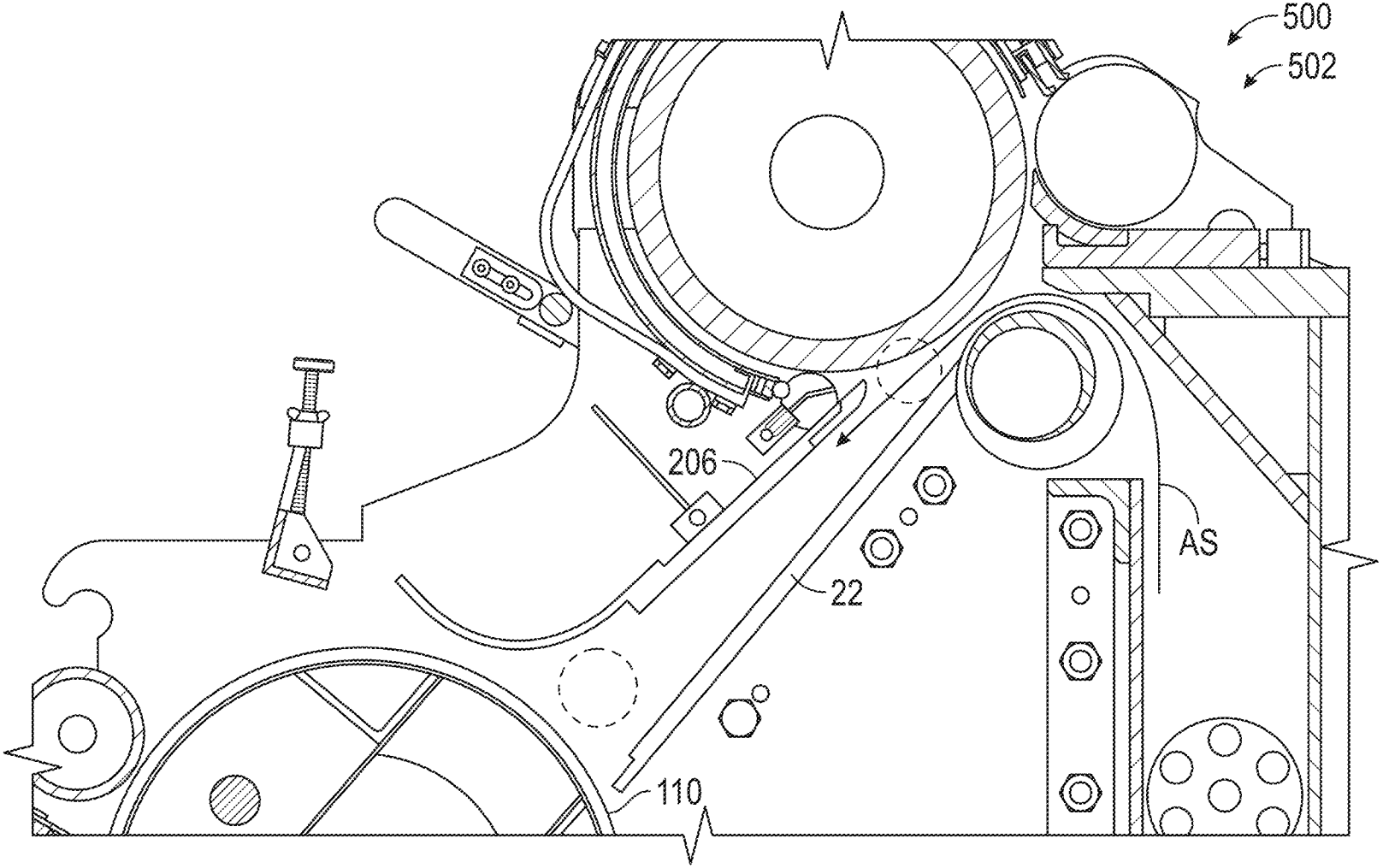
FIG. 7 is a schematic cross-section of a portion of a fifth machine for forming a random fiber web according to an embodiment of the present disclosure.

FIG. 7 shows an embodiment of a system 500 that is part of a machine 502 that includes the doffer plate 206 of FIGS. 4 and 5 in combination with a lower slide plate 22 as previously shown and described in FIGS. 1 and 3. In some embodiments, ambient air may enter the interior of the machine 502 through one or more passages (not shown in FIG. 7) akin to passage 610 of FIG. 8. It should be understood that the one or more passages need not be positioned in the location shown in the figures, which is merely indicated for schematic purposes.

The present inventors have determined the various channel designs of FIGS. 3-7 are configured to more evenly spread the air supply AS across the respective channel with the plurality of fibers entrained therein prior to the air supply reaching the collector 110. This allows for a more even cross-web deposition on the collector 110 when forming the random fiber web.

Figure 8:
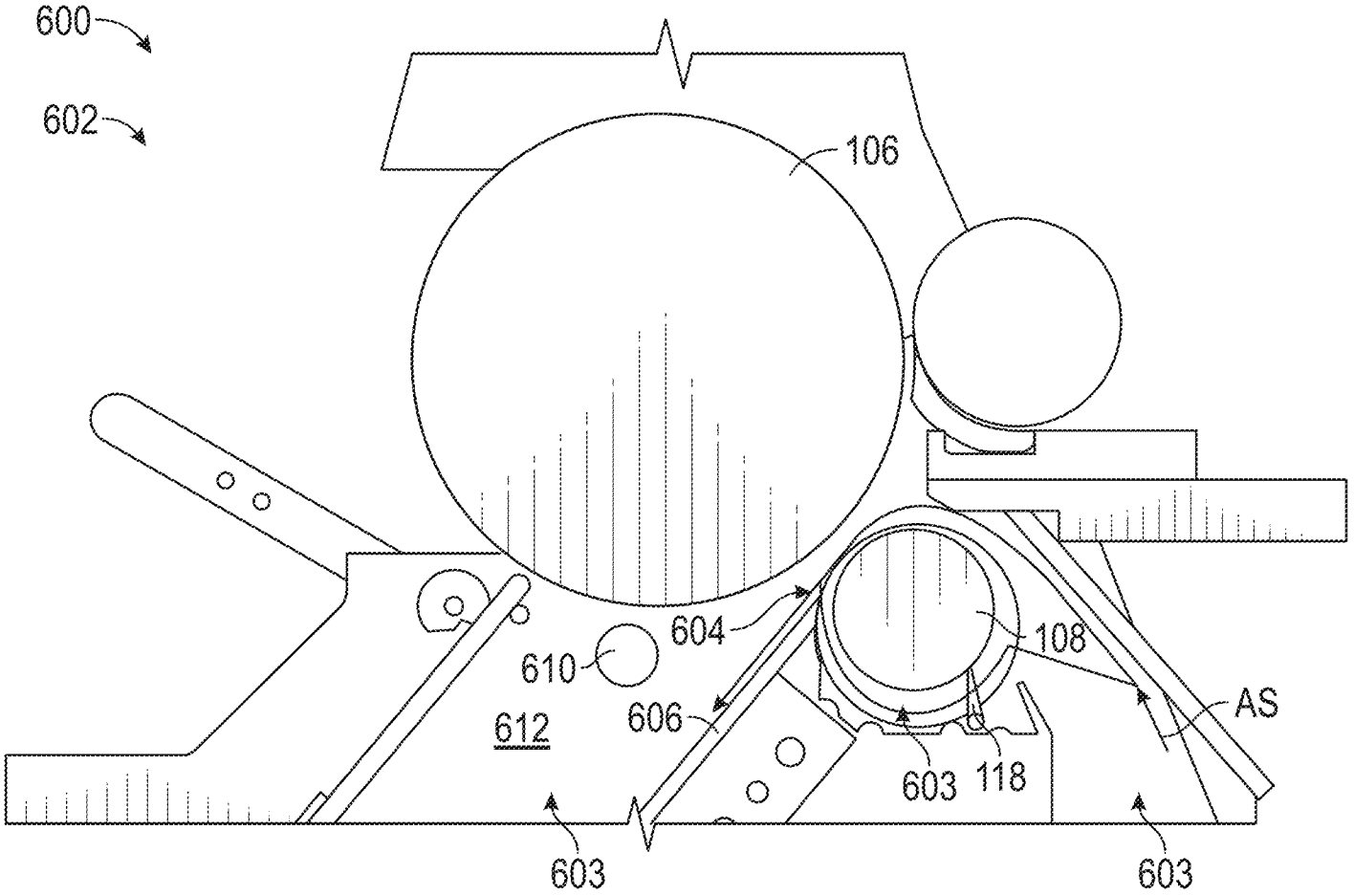
FIG. 8 a schematic cross-section of a portion of a sixth machine for forming a random fiber web according to an embodiment of the present disclosure.

FIG. 8 shows an embodiment of a system 600 that is part of a machine 602 that includes the damper 118 adjacent the saber roll 108 to control air flow around the saber roll 108. The damper 118 can be positioned in a channel 603 upstream of the doffing location as defined by a direction of flow of the air supply AS. The machine 602 of FIG. 8 provides a gap 604 between the saber roll 108 and a lower slide plate 606 that is part of the channel 603. An amount of the air supply AS could pass through the gap 604 in addition to passing along a main portion of the channel 603 around the saber roll 108 and between the saber roll 108 and the lickerin roll 106. Thus, in the embodiment of FIG. 8, the air supply AS can pass to either side of the saber roll 108. However, the present inventors propose the damper 118, which can be positioned in the gap 604, can be moveable to control the amount of the air supply AS allowed to pass through the gap 604. The damper 118 can be configured to be selectively moveable toward and away from the saber roll 108 to selectively allow for passage of at least a portion of the air supply AS around a part of the saber roll 108 that does not interface with the lickerin roll 106. Put another way, the damper 118 can be configured to be selectively moveable toward and away from the saber roll 108 and in some cases can contact the saber roll 108 as shown in FIG. 8, to open, restrict and/or close gap 604.

In the embodiment of FIG. 8, one or more passages 610 communicate with the channel 603 downstream of the doffing location such that an amount of the air supply AS can pass therethrough. Alternatively, the one or more passages 610 allow an ambient air from outside the machine 602 side wall 612 to pass therethrough and into the channel 603. It should be understood that the one or more passages 610 need not be positioned in the location shown in the figures, which is merely indicated for schematic purposes.

Figure 9:
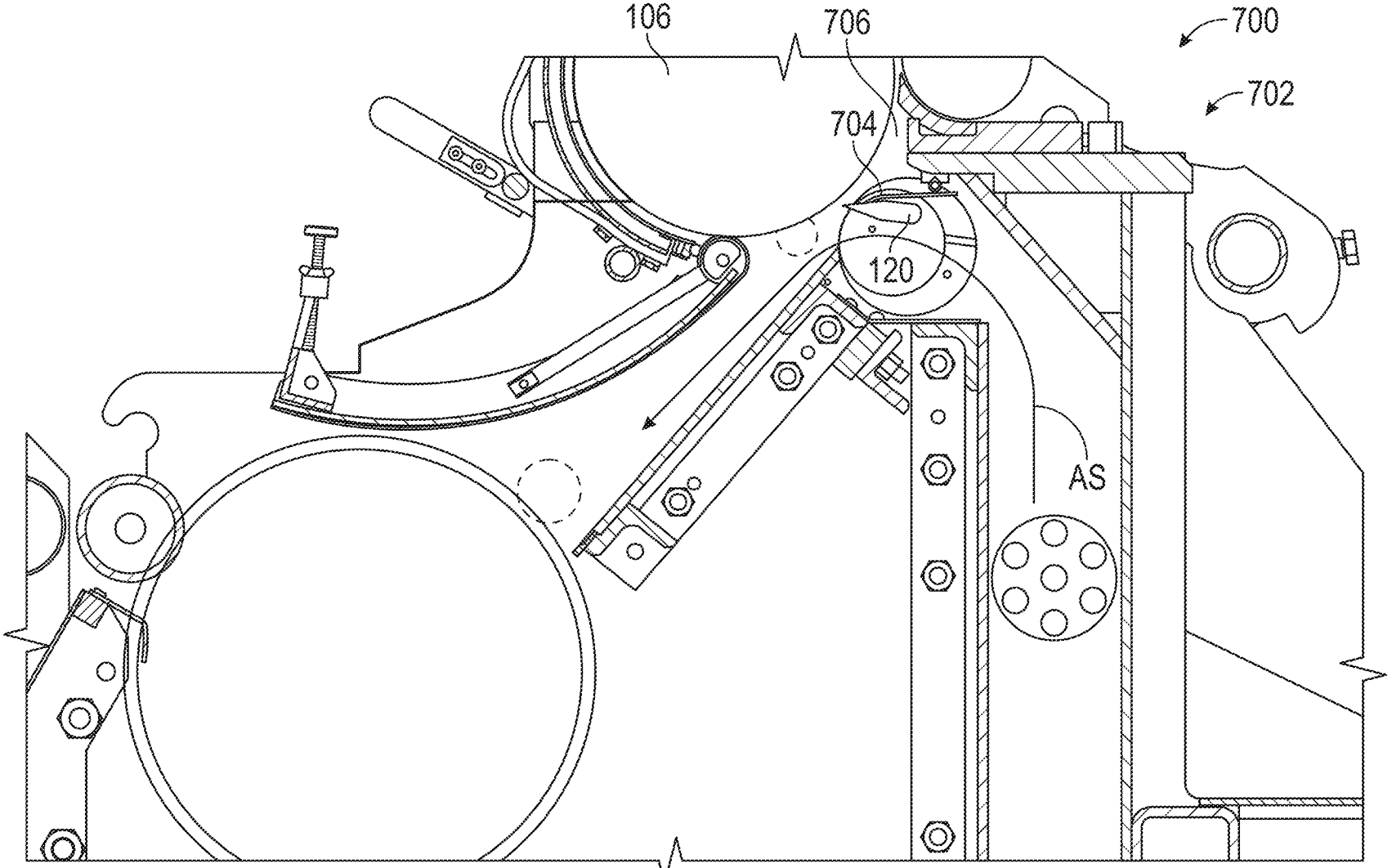
FIG. 9 is a schematic cross-section of a portion of a seventh machine for forming a random fiber web according to an embodiment of the present disclosure

FIG. 9 shows an embodiment of a system 700 that is part of a machine 702 that includes the airfoil 120. The embodiment of FIG. 9 also includes an air deflector assembly 704 similar to the air deflector assembly 118 previously described. Thus, the air deflector assembly 704 can comprise a plate configured to deflect the air supply AS away from the doffing location. The doffing location can be located in a second volume 706 defined between the air deflector assembly 704 and the lickerin roll 106. In the embodiment of FIG. 9, the system 700 and the machine 702 does not include a saber roll but rather utilizes the airfoil 120 to control the flow of the air supply AS. The airfoil 120 can be moveable toward and away from the lickerin roll 106 and the air deflector assembly 704 to allow relatively more air or less air from the air supply AS to reach the doffing location within the second volume 706. In particular, the airfoil 120 can be moveable to open a gap (not shown) between the airfoil 120 and the air deflector assembly 704 to allow an amount of air from the air supply AS into the second volume 706. The airfoil 120 can moveable to the position of FIG. 9 to contact the air deflector assembly 704 so that air from the air supply is restricted/deflected from the doffing location. In some embodiments, ambient air may enter the interior of the machine 702 through one or more passages (not shown in FIG. 9) akin to passage 610 of FIG. 8. It should be understood that the one or more passages need not be positioned in the location shown in the figures, which is merely indicated for schematic purposes.

Figure 10:
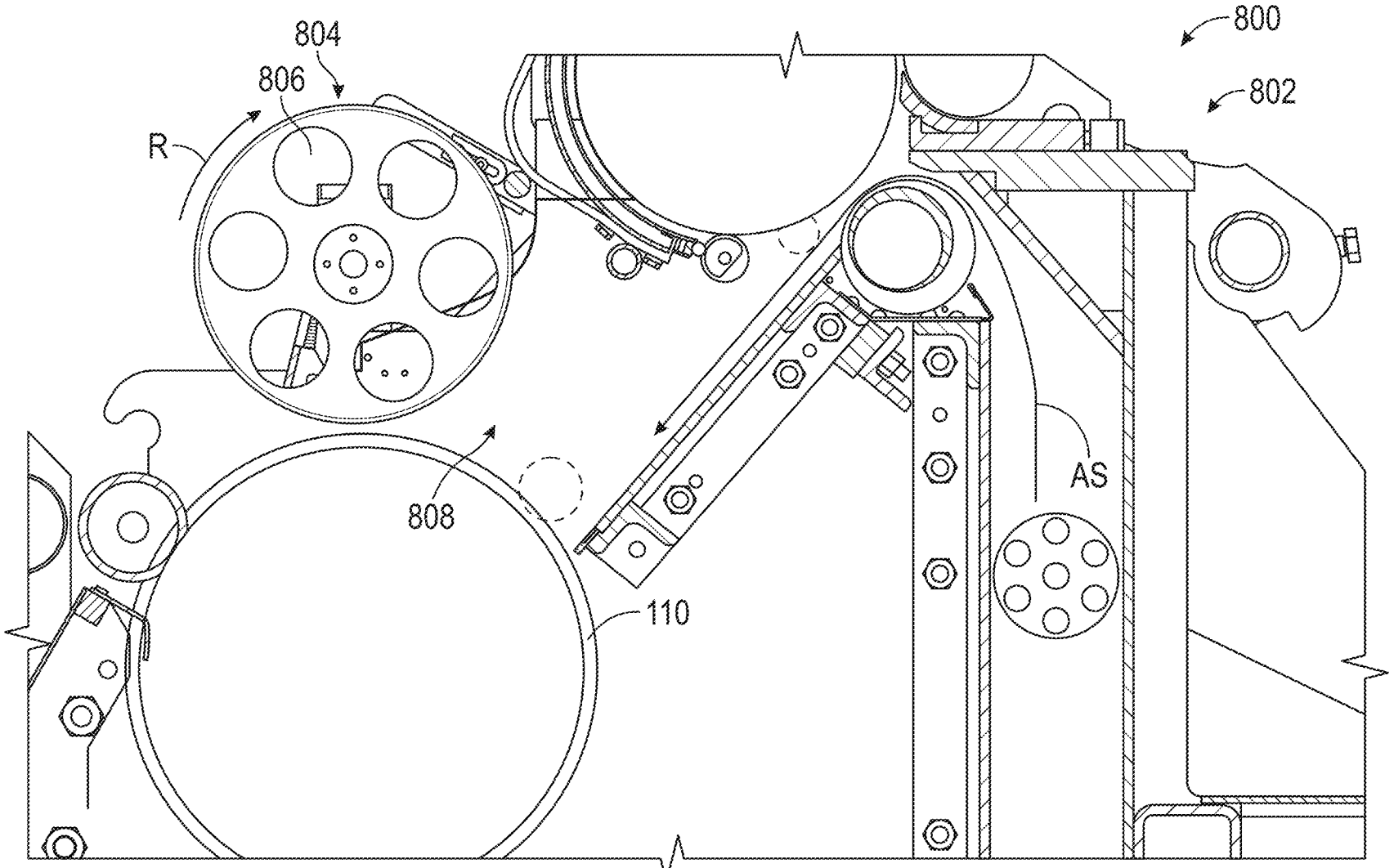
FIG. 10 is a schematic cross-section of a portion of an eighth machine for forming a random fiber web according to an embodiment of the present disclosure.

FIG. 10 shows an embodiment of a system 800 that is part of a machine 802 that includes a drum 804. In FIG. 10, the doffer plate has been replaced by the drum 804. The drum 804 can spaced from the lickerin roll 106 and can be positioned adjacent the collector 110. The drum 804 can include one or more passages 806 that communicate (for example, via openings through the cylindrical wall of drum 804) with a channel 808 that provides for passage of the air supply AS with the plurality of fibers entrained therein downstream of the doffing location to the collector 110. The one or more passages 806 are configured to allow an amount of the air supply AS to pass therethrough should conditions within the system 800 and machine 802 dictate. Alternatively, the one or more passages 810 (not shown in FIG. 10) are configured to allow an ambient air from outside the machine 602 to pass therethrough and into the channel 808. It should be understood that the one or more passages 810 may be positioned akin to the positioning of passage 610 in FIG. 8, but need not be positioned in the location shown in the figures, which is merely indicated for schematic purposes.

The drum 804 can provide a moving surface and can be configured to move relatively closer or further away from the collector 110 to change the size and shape of the channel 808 (which is partially defined by the drum 804). The drum 804 can rotate as indicated by arrow R in FIG. 10. Such rotation can be the result of passage of the ambient air or the air supply AS in some embodiments. In other embodiments, the drum 804 can be powered to facilitate the rotation shown by the arrow R. Although the drum 804 is specifically shown in FIG. 10 other embodiments can contemplate a plate, nip, belt, roll, etc. or another type of apparatus that can change position to change the size and shape of the channel 808. In yet further embodiments, no apparatus (e.g., no housing, plate, nip, drum, belt, roll, etc.) may be provided such that the channel 808 is open to the ambient in the location where the drum would be for free flow and exchange of air to or from the air supply AS.

Figure 11:
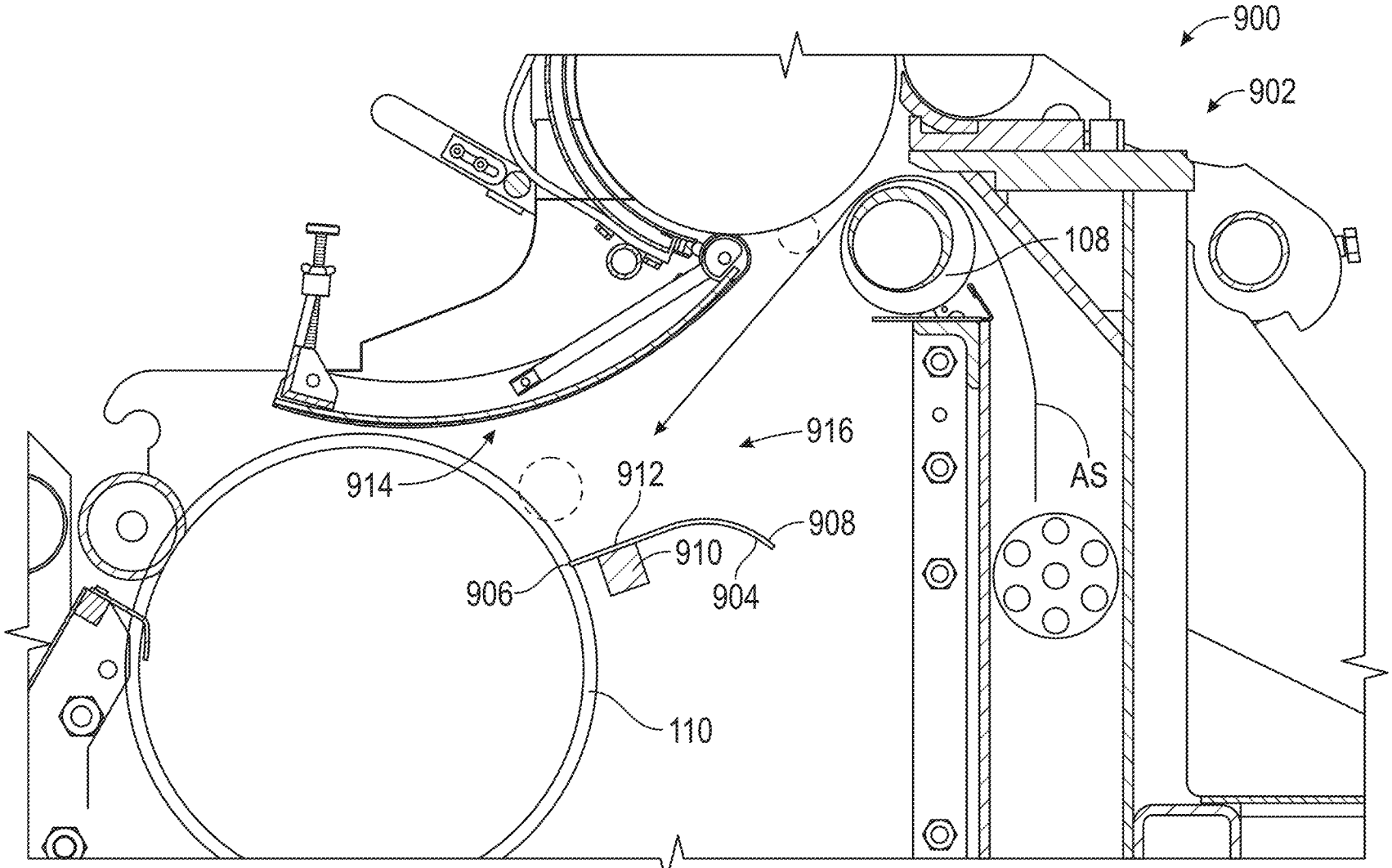
FIG. 11 is a schematic cross-section of a portion of a ninth machine for forming a random fiber web according to an embodiment of the present disclosure.

FIG. 11 shows an embodiment of a system 900 that is part of a machine 902 that includes a lower slide plate 904 that has a truncated extent relative to the lower slide plates previously shown. In particular, rather than extending from adjacent the saber roll 108 as is the case in other embodiments discussed herein, the lower slide plate 904 can be disposed adjacent or at the collector 110 on a first end 906 and may only extend a short distance therefrom to a second end 908. Thus, in FIG. 11 the lower slide plate 904 extends to adjacent the collector 110 but is connected to the side housing 910 in only a single location 912. A remainder of the lower slide plate 904 including the second end 908 can cantilever from the single location 912. In the embodiment of FIG. 11, a channel 914 provides for passage of the air supply AS with the plurality of fibers entrained therein downstream of the doffing location to the collector 110. As shown in FIG. 11, the channel 914 can be open to the ambient in a location 916 where the lower slide plate had been located in prior embodiments such as those of FIGS. 3-10. This can allow for free flow and exchange of air to or from the air supply AS. It should be understood that the one or more passages 916 need not be positioned in the location shown in the figures, which is merely indicated for schematic purposes.

As used herein:

The term "a", "an", and "the" are used interchangeably with "at least one" to mean one or more of the elements being described.

The term "and/or" means either or both. For example, "A and/or B" means only A, only B, or both A and B.

The terms "including," "comprising," or "having," and variations thereof, are meant to encompass the items listed thereafter and equivalents thereof as well as additional items.

The term "adjacent" refers to the relative position of two elements, such as, for example, two layers, that are close to each other and may or may not be necessarily in contact with each other or that may have one or more layers separating the two elements as understood by the context in which "adjacent" appears.

All scientific and technical terms used herein have meanings commonly used in the art unless otherwise specified. The definitions provided herein are to facilitate understanding of certain terms used frequently in this application and are not meant to exclude a reasonable interpretation of those terms in the context of the present disclosure.

Unless otherwise indicated, all numbers in the description and the claims expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviations found in their respective testing measurements.

The term "substantially" means within 20 percent (in some cases within 15 percent, in yet other cases within 10 percent, and in yet other cases within 5 percent) of the attribute being referred to. Thus, a value A is "substantially similar" to a value B if the value A is within plus/minus one or more of 5%, 10%, 20% of the value A.

Features and advantages of the present disclosure will be further understood upon consideration of the detailed description as well as the appended claims.

The recitation of numerical ranges by endpoints includes all numbers subsumed within that range (e.g. a range from 1 to 5 includes, for instance, 1, 1.5, 2, 2.75, 3, 3.80, 4, and 5) and any range within that range.

Although the present disclosure has been described with reference to preferred embodiments, workers skilled in the art will recognize that changes can be made in form and detail without departing from the spirit and scope of the present disclosure.

Various Notes & Examples

Example 1 is a method of forming a random fiber web using pneumatic fiber feeding system. The method can optionally comprise: providing a plurality of moveable apparatuses including a lickerin and a feeder, the lickerin configured to remove a plurality of fibers from a fibrous mat delivered to adjacent the lickerin by the feeder; doffing the plurality of fibers from the lickerin at a doffing location within the system; communicating an air supply to entrain the plurality of fibers with the air supply after the doffing; and collecting the plurality of fibers from the air supply to form the random fiber web.

Example 2 is the method of Example 1, and can further optionally comprise controlling the amount of the air supply to at least one of the doffing location and downstream of the doffing location as defined by a direction of flow of the air supply Example 3 is the method of Example 2, wherein controlling the amount of air supply can include providing for one or more of a damper, a nose bar extension, an air deflector plate, an airfoil and one or more passages in a housing of the system.

Example 4 is the method of any one or any combination of Examples 1-3 and can further optionally comprise positioning the doffing location and trajectory of the doffing to reduce contact of the air supply and the plurality of fibers with components of the system when the plurality of fibers are entrained and prior to the collecting.

Example 5 is the method of any one or any combination of Examples 1-4, and can further optionally comprise separating the plurality of fibers from the air supply until after the doffing location.

Example 6 is a pneumatic fiber feeding system for forming a random fiber web. The system can optionally comprise: a feeder; a lickerin configured to remove a plurality of fibers from a fibrous mat delivered to adjacent the lickerin by the feeder and configured to doff the plurality of fibers from the lickerin; a channel communicating an air supply to a space adjacent the lickerin, the space including a doffing location where the doff of the plurality of fibers from the lickerin occurs; and a collector positioned to capture the plurality of fibers once doffed into the air supply, the plurality of fibers forming the random fiber web on the collector.

Example 7 is the system of Example 6, wherein the channel downstream of the doffing location as defined by a direction of flow of the air supply can be partially formed by a first plate, and wherein the first plate can have a substantially planar surface along a channel interfacing extent thereof that is configured to substantially align with the direction of flow of the air supply.

Example 8 is the system of Example 7, wherein a first end of the first plate can extend past at least a majority of a doffer bar to adjacent the lickerin.

Example 9 is the system of any one or any combination of Examples 7-8, wherein the channel downstream of the doffing location can be additionally partially formed by a second plate, wherein the first plate and the second plate are shaped and positioned relative to one another to cause a restriction in the channel prior to the air supply with the plurality of fibers entrained therein reaching the collector.

Example 10 is the system of Example 9, wherein the second plate can have a section that is convex in shape when viewed in cross-section to spread the air supply with the plurality of fibers entrained therein prior to the air supply reaching the collector.

Example 11 is the system of anyone or any combination of Examples 6-10, and can further optionally comprise one or more passages that communicate with the channel downstream of the doffing location, the one or more passages configured to allow both an amount of the supply air to pass therethrough and allow an amount of an ambient air to pass therethrough and into the channel.

Example 12 is the system of Example 11, wherein the one or more passages can be formed by one of the first plate, the second plate, a side housing or a drum.

Example 13 is the system of any one or any combination of Examples 6-12, and can further optionally comprise a deflector plate positioned adjacent the lickerin and extending into the space, wherein the deflector plate is positioned to keep the air supply and the plurality of fibers separated until after the doffing location.

Example 14 is the system of Example 13, and can further optionally comprise a nose bar assembly positioned between the lickerin and the deflector plate, and wherein the nose bar assembly is configured to extend the doffing location past the feed roll and into a second space defined between lickerin and the deflector plate.

Example 15 is the system of any one or any combination of Examples 6-14, and can further optionally comprise one of: an airfoil positioned in the channel, the airfoil configured to be selectively moveable toward and away from the deflector plate to selectively allow for passage of at least a portion of the supply air into the second space; or a damper positioned in the channel and configured to be selectively moveable toward and away from a saber roll to selectively allow for passage of at least a portion of the supply air around a part of the saber roll that does not interface with the lickerin.

Example 16 is a pneumatic fiber feeding system for forming a random fiber web. The system can optionally comprise: a plurality of moveable apparatuses including a lickerin and a feeder, the lickerin configured to remove a plurality of fibers from a fibrous mat delivered to adjacent the lickerin by the feeder, wherein the lickerin is configured to doff the plurality of fibers from the lickerin; a channel communicating an air supply to a space adjacent the lickerin, the space including a doffing location where the doff of the plurality of fibers from the lickerin occurs; a collector positioned to capture the plurality of fibers once doffed into the main air supply, the plurality of fibers forming the random fiber web on the collector; and at least one of: a drum, one or more passages that communicate with the channel downstream of the doffing location, and a restriction in the channel downstream of the doffing location and prior to the collector.

Example 17 is the system of Example 16, and can further optionally comprise a deflector plate positioned adjacent the lickerin and extending into the space, wherein the deflector plate is positioned to keep the air supply and the plurality of fibers separated until after the doffing location.

Example 18 is the system of Example 17, and can further optionally comprise a nose bar assembly positioned between the lickerin and the deflector plate, and wherein the nose bar assembly is configured to extend the doffing location past the feed roll and into a second space defined between lickerin and the deflector plate.

Example 19, the system of any one or any combination of Examples 17-18, and can further optionally comprise one of: an airfoil positioned in the channel, the airfoil configured to be selectively moveable toward and away from the deflector plate to selectively allow for passage of at least a portion of the supply air into the second space; or a damper positioned in the channel and configured to be selectively moveable toward and away from a saber roll to selectively allow for passage of at least a portion of the supply air around a part of the saber roll that does not interface with the lickerin.

Example 20 is the system of any one or any combination of Examples 16-19, wherein one or more of the drum, a first plate and a second plate can form portions of the channel and can be are configured to be at least one of removeable from the system and moveable, and wherein when the one or more of the drum, the first plate and the second plate when removed allow the channel to communicate with an ambient air.

Example 21 is the system of any one or any combination of Examples 16-20, wherein the drum can have the one or more passages therethrough, and wherein the drum can be positionable to form a portion of the channel and is operably rotatable relative to the channel.

What is claimed is:

1. A method of forming a random fiber web using a pneumatic fiber feeding system, the method comprising:

providing a plurality of moveable apparatuses including a lickerin and a feeder, the lickerin configured to remove a plurality of fibers from a fibrous mat delivered to the lickerin by the feeder;

doffing the plurality of fibers from the lickerin at a doffing location within the system, wherein the doffing location is adjacent a termination point of a nose bar;

communicating an air supply to entrain the plurality of fibers;

separating the plurality of doffed fibers from the air supply, using an air deflector assembly, wherein the air deflector assembly is mounted to a housing of the pneumatic fiber feeding system, and wherein the air deflector assembly is positioned between the lickerin and a saber roll, wherein the air deflector assembly and the lickerin define a space that comprises the doffing location, and wherein the air deflector assembly is positioned and configured to deflect the air supply away from the doffing location;

entraining the plurality of doffed fibers in the air supply, wherein the plurality of fibers move through the space and are entrained in the communicated air supply after passing an end of the air deflector assembly; and collecting the plurality of fibers from the air supply to form the random fiber web.

2. The method of claim 1, further comprising controlling an amount of the air supply to at least one of the doffing location and downstream of the doffing location as defined by a direction of flow of the air supply, wherein controlling the amount of air supply includes providing one or more of a damper, a nose bar extension, an airfoil and one or more passages in a housing of the system.

3. The method of claim 1, further comprising positioning the doffing location and trajectory of the doffing to reduce contact of the air supply and the plurality of fibers with components of the system when the plurality of fibers are entrained and prior to the collecting.

4. A pneumatic fiber feeding system for forming a random fiber web, the system comprising:

a feeder;

a lickerin configured to remove a plurality of fibers from a fibrous mat delivered to the lickerin by the feeder and configured to doff the plurality of fibers from the lickerin;

a channel communicating an air supply to a first space adjacent the lickerin, the first space including a doffing location where a doff of the plurality of fibers from the lickerin occurs;

a collector positioned to capture the plurality of fibers once doffed into the air supply, the plurality of fibers forming the random fiber web on the collector;

a nose bar assembly that extends along the lickerin and toward a saber roll; and an air deflector assembly mounted between the lickerin and the saber roll, wherein the nose bar assembly is configured to extend the doffing location past the feeder and into a second space defined between the lickerin and the air deflector assembly, wherein the second space is distinct from the first space; wherein the air deflector assembly is positioned within the pneumatic fiber feeding system such that the air deflector assembly keeps the air supply and the plurality of fibers separated after the doffing location, until after the plurality of fibers clear an end of the air deflector assembly.

5. The system of claim 4, wherein the channel downstream of the doffing location is defined by a direction of flow of the air supply, and is partially formed by a first plate, and wherein the first plate has a substantially planar surface along a channel interfacing extent thereof that is configured to substantially align with the direction of flow of the air supply.

6. The system of claim 5, wherein a first end of the first plate extends past at least a majority of a doffer bar to adjacent the lickerin.

7. The system of claim 5, wherein the channel downstream of the doffing location is additionally partially formed by a second plate, wherein the first plate and the second plate are shaped and positioned relative to one another to cause a restriction in the channel prior to the air supply with the plurality of fibers entrained therein reaching the collector.

8. The system of claim 7, wherein the second plate has a section that is convex in shape when viewed in cross-section to spread the air supply with the plurality of fibers entrained therein prior to the air supply reaching the collector.

9. The system of claim 4, further comprising one or more passages that communicate with the channel downstream of the doffing location, wherein the one or more passages are configured to allow an amount of supplied air, from the air supply, to pass therethrough, and wherein the one or more passages are configured to allow an amount of an ambient air to pass therethrough and into the channel.

10. The system of claim 9, wherein the one or more passages are formed by one of the first plate, a second plate, a side housing or a drum.

11. The system of claim 4, further comprising:

an airfoil positioned in the channel, the airfoil configured to be selectively moveable toward and away from the deflector assembly to selectively allow for passage of at least a portion of the air supply into a second space, wherein the second space is defined between the lickerin and the air deflector assembly.

12. The system of claim 4, and further comprising a damper positioned in the channel and configured to be selectively moveable toward and away from the saber roll to selectively allow for passage of at least a portion of the air supply around a part of the saber roll that does not interface with the lickerin.

* * * * *